US005580240A

United States Patent [19]

Hattori

[11] Patent Number: 5,580,240

[45] Date of Patent: Dec. 3, 1996

[54] COMBUSTION NOZZLE FOR GAS LIGHTER

[76] Inventor: Tadamichi Hattori, 12-5, Shiratori 2-chome, Asao-ku, Kawasaki-shi, Kanagawa-ken, 215, Japan

[21] Appl. No.: 374,778

[22] PCT Filed: Jul. 23, 1993

[86] PCT No.: PCT/JP93/01032

§ 371 Date: Jan. 26, 1995

§ 102(e) Date: Jan. 26, 1995

[87] PCT Pub. No.: WO94/02785

PCT Pub. Date: Feb. 3, 1994

[30] Foreign Application Priority Data

Jul. 27, 1992 [JP] Japan ..... 4-052543

[51] Int. Cl.[6] ..... F23D 14/28

[52] U.S. Cl. ..... 431/344; 251/11; 251/337

[58] Field of Search ..... 431/344, 264, 431/268, 243, 258, 206; 251/11, 337

[56] References Cited

U.S. PATENT DOCUMENTS

| | | | |
|---|---|---|---|
| 3,205,675 | 9/1965 | Matthies | 251/11 |
| 3,856,259 | 12/1974 | Doherty, Jr. | 251/11 |

FOREIGN PATENT DOCUMENTS

| | | | |
|---|---|---|---|
| 56-8255 | 2/1981 | Japan . | |
| 59-134410 | 8/1984 | Japan . | |
| 2-217715 | 8/1990 | Japan . | |
| 3-233218 | 10/1991 | Japan . | |
| 4-57053 | 5/1992 | Japan . | |
| WO90/09553 | 8/1990 | WIPO | 431/344 |

*Primary Examiner*—James C. Yeung
*Attorney, Agent, or Firm*—R. J. Kubovcik, Esq.

[57] ABSTRACT

The present invention relates to a combustion nozzle for a gas lighter, particularly a nozzle structure provided with an internal, automatic flame extinguishing device. Within a nozzle cylinder is disposed a second valve for closing a to-be-closed portion under the action of a shape memory member. The second valve is provided with a push-back portion which undergoes an elastic deformation upon closing of the to-be-closed portion and thereby urge the shape memory member in a direction in which the shape memory member is pushed back. This structure permits omission of a return spring and hence reduction in the number of components used; besides, the shape memory member such as, for example, a shape memory alloy coil, can revert to its original shape to a sufficient extent even without imparting a bidirectional property thereto.

12 Claims, 8 Drawing Sheets

COMBUSTION NOZZLE FOR GAS LIGHTER

DESCRIPTION

1. Technical Field

The present invention relates to a combustion nozzle for a gas lighter and particularly to a nozzle structure having an internal, automatic flame extinguishing device.

2. Background Art

Heretofore, gas lighters of various structures have been proposed. One of them is a gas lighter having an automatic flame extinguishing device incorporated therein, the automatic flame extinguishing device using a coiled shape memory alloy or the like disposed in the interior of the gas lighter to close a gas flow path for the extinguishment of flame when combustion continues for a time longer than necessary, with a view to preventing the occurrence of a possible accident, (refer, for example, to Japanese Utility Model Application No.98519/90).

FIG. 8 is a partial sectional view of a combustion nozzle and the vicinity thereof in a conventional gas lighter with an automatic flame extinguishing device incorporated therein.

The lighter illustrated in FIG. 8 is of a file-ignition flint type. As to the automatic flame extinguishing device, it is also the case with a piezo-ignition type.

Fuel gas is stored within a fuel tank 1. When the lighter is in use, the lighter gas flows out through a gas outlet hole 3 while the flow rate thereof is restricted by means of a flow rate control member 2. On the other hand, when the lighter is not in use, a first valve 4 fixed to the bottom of a nozzle cylinder 5 closes the gas outlet hole 3, the nozzle cylinder 5 being urged by means of a spring (not shown).

An ignition flint 11 is kept in pressure contact with a file 10 by means of a flint pushing spring 12. When the user of the lighter rotates the file 10, the ignition flint 11 is scraped off while generating heat, resulting in burning as sparks, which are scattered above a gas blow-off hole 5*a*. Further, when the user depresses one end (not shown) on the right-hand side in FIG. 8 of a gas valve opening lever 9, simultaneously with the rotation of the file 10, the opposite end, indicated at 9*a*, of the lever 9 rises, whereby the nozzle cylinder 5, which is engaged with the lever 9, is lifted. As a result, the first valve 4 is also lifted together with the nozzle cylinder 5 because it is fixed to the nozzle cylinder 5 through a bottom plug 6, whereby the gas outlet hole 3 is opened, so that the fuel gas in the fuel tank 1 passes through the gas outlet hole 3, flows along the side face of the nozzle cylinder 5, then enters the interior of the nozzle cylinder from a lateral hole 5*b*, passes through an internal fuel gas passage 5*c* of the nozzle cylinder and blows off from the gas blow-off hole 5*a*. At this time, the gas is ignited by the foregoing sparks to form a flame. An O-ring 7 is held in a position between the tank wall and the nozzle cylinder 5 by means of a cap 8 to prevent the fuel gas from leaking to the exterior from the outer periphery of the nozzle cylinder 5 while the lighter is in use.

In the interior of the nozzle cylinder 5 are mounted a shape memory alloy coil 14, a second valve 13 and a return spring 15, to constitute an automatic flame extinguishing device.

A lower portion 14*a* of the shape memory alloy coil 14 is press-fitted on a bottom plug 6, the bottom plug 6 being fitted into the nozzle cylinder 5 from the bottom side of the same cylinder, while the second valve 13 is press-fitted and fixed into an upper end 14*b* of the shape memory alloy coil 14. The return spring 15 is disposed in a position in which it pushed back the second valve 13 downward. Upon ignition of the fuel gas which has brown off from the gas blow-off hole 5*a* in the manner described above, the temperature of the nozzle cylinder 5 rises, and if it exceeds a predetermined level in the event of occurrence of an abnormal continuous combustion, the shape memory alloy coil 14 expands and pushes the second valve 13 upward, so that a portion 5*d* to be closed of the internal fuel gas passage 5*c*, which portion is located halfway of the same passage, is closed by the second valve 13. As a result, the ejection of the fuel gas from the gas blow-off hole 5*a* is shut off and the flame is extinguished. When the shape memory alloy coil 14 expands, it pushes up the second valve 13 and at the same time compresses the return spring 15, while upon cooling of the coil 14, the coil reverts to its original shape by virtue of the spring 15 and thus assumes an operative state again.

As described above, the conventional automatic flame extinguishing device comprises the three components of shape memory alloy coil 14, second valve 13 and return spring 15. These components which are mounted within the internal fuel gas passage 5*c* of the nozzle cylinder 5 are very small because the passage 5*c* is required to be very narrow, e.g. 1.5 to 2.0 mm in inside diameter. Therefore, the force of the shape memory alloy coil 14 for pushing up the second valve 13 is also very small, not greater than 100 grams. Accordingly, the return spring 15 is a very small and weak spring which is compressed by only a reserve force of such force small but sufficient to close the to-be-closed portion 5*d*. For this reason, if even a slight force is exerted on the return spring 15 at the time of assembly, the return spring will undergo a plastic deformation such as collapse, and thus the handling of the return spring 15 is difficult. Further, aside from such problem of difficulty in handling the return spring, the smaller the number of components used, the more advantageous in point of cost or reliability.

As one method for omitting the return spring it has been proposed to train the shape memory alloy coil 14 and thereby impart a bidirectional property thereto.

In this case, however, such training required for imparting a bidirectional property to the shape memory alloy coil 14 causes an increase of cost. Further, when the shape memory alloy coil 14 is deformed at a temperature exceeding a predetermined level, there is generated a force of, that is, several ten grams or so, as mentioned above, but even if a bidirectional property is imparted to the shape memory alloy coil 14, there is generated only a smaller force at the time of cooling and restoration to the original shape of the coil. Therefore, even a very slight friction or engagement with something may prevent the coil 14 from reverting to its original shape and hence prevent it from functioning properly.

DISCLOSURE OF THE INVENTION

The present invention has been accomplished in view of the above-mentioned circumstances and it is the object of the invention to provide a gas lighter combustion nozzle capable of omitting the return spring to reduce the number of components in comparison with the conventional proposals referred to above and having an automatic flame extinguishing device provided with a shape memory alloy coil or the like which can revert to its original shape to a sufficient extent even without imparting a bidirectional property thereto.

In order to achieve the above-mentioned object, the combustion nozzle for a gas lighter according to the present invention includes:

a nozzle cylinder having a gas blow-off hole formed in the top portion thereof and also having an internal fuel gas passage in communication with the gas blow-off hole;

a first valve held in the bottom portion of the nozzle cylinder to close a gas outlet hole through which is conducted the fuel gas from a fuel gas storage tank into the interior of the nozzle cylinder;

a second valve disposed movably within the nozzle cylinder to close a to-be-closed portion located halfway of the internal fuel gas passage; and a shape memory member fixed at one end thereof to a predetermined position in the internal fuel gas passage and at the opposite end to the second valve, the shape memory member holding the second valve in a position spaced from the to-be-closed portion at a temperature not higher than a predetermined temperature and being deformed at a temperature exceeding the predetermined temperature, thereby causing the second valve to move up to the to-be-closed portion for closing the internal fuel gas passage, and is characterized in that the second valve is provided with a push-back portion which undergoes an elastic deformation upon closing of the to-be-closed portion to urge the shape memory member in a direction in which the shape memory member is pushed back.

Valves are usually formed of an elastic material such as rubber, and the present invention utilizes this point. More specifically, according to the construction of the present invention, the second valve referred to above is formed with a push-back portion as a substitute for the foregoing return spring, and when the to-be-closed portion is closed by the second valve, the push-back portion undergoes an elastic deformation to urge the shape memory member in a direction in which the shape memory member is pushed back. Thus, the second valve possesses both the function of opening and closing the to-be-closed portion and the function of the foregoing return spring, so that the return spring is no longer necessary, nor is it necessary to perform the training for imparting a bidirectional property to the shape memory member. Consequently, the number of components used becomes smaller and this is advantageous in point of cost and contributes to the improvement of reliability.

Thus, in the combustion nozzle for a gas lighter according to the present invention, since the second valve disposed within the nozzle cylinder to close the to-be-closed portion under the action of the shape memory member is provided with a push-back portion which undergoes an elastic deformation upon closing of the to-be-closed portion to urge the shape memory member in a direction to push back the same member, it is no longer necessary to use the return spring, that is, the number of components used becomes smaller, and the shape memory member reverts to its original shape even without imparting a bidirectional property thereto.

BEST MODE FOR CARRYING OUT THE INVENTION

Embodiments of the present invention will be described hereinunder.

Figure 1A:
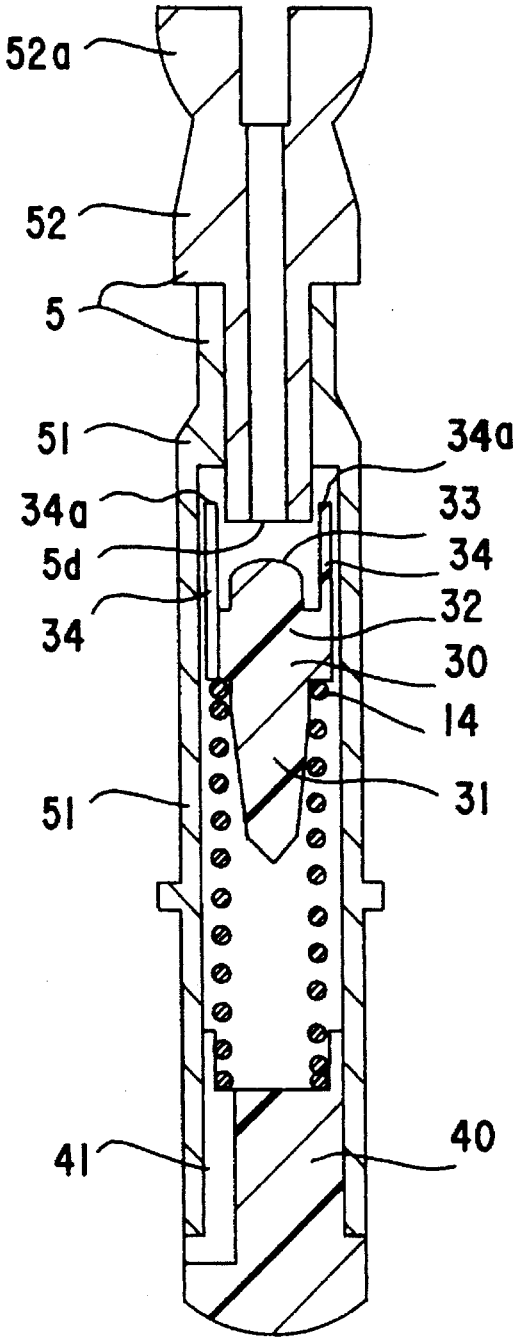
FIG. 1 is a sectional view showing a nozzle cylinder and the interior thereof according to the first embodiment of the present invention.
Figure 1B:
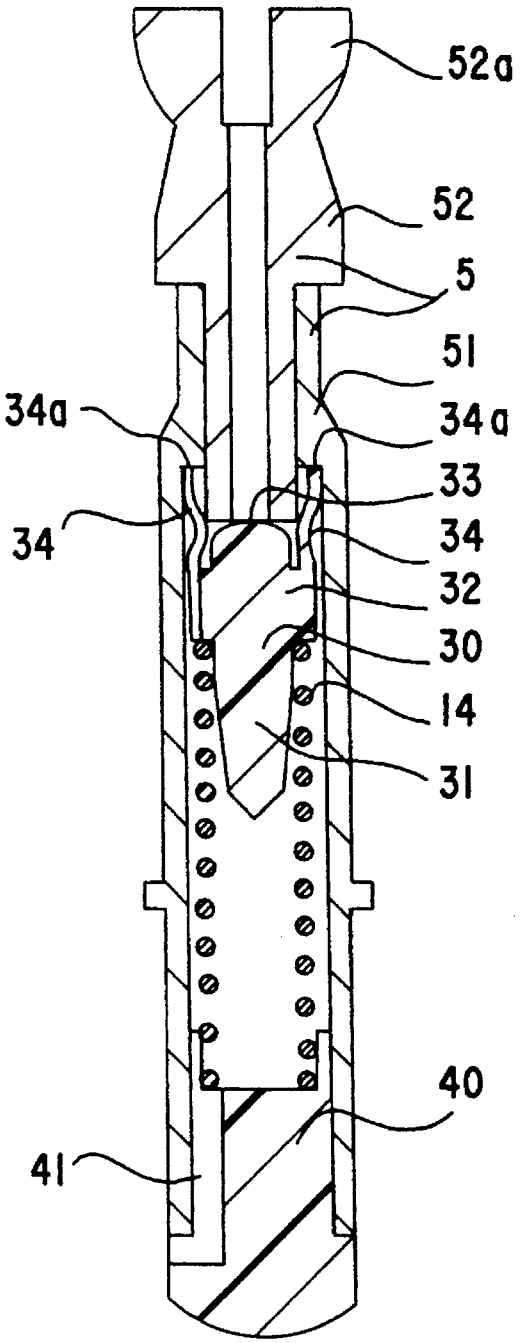
Figure 2:
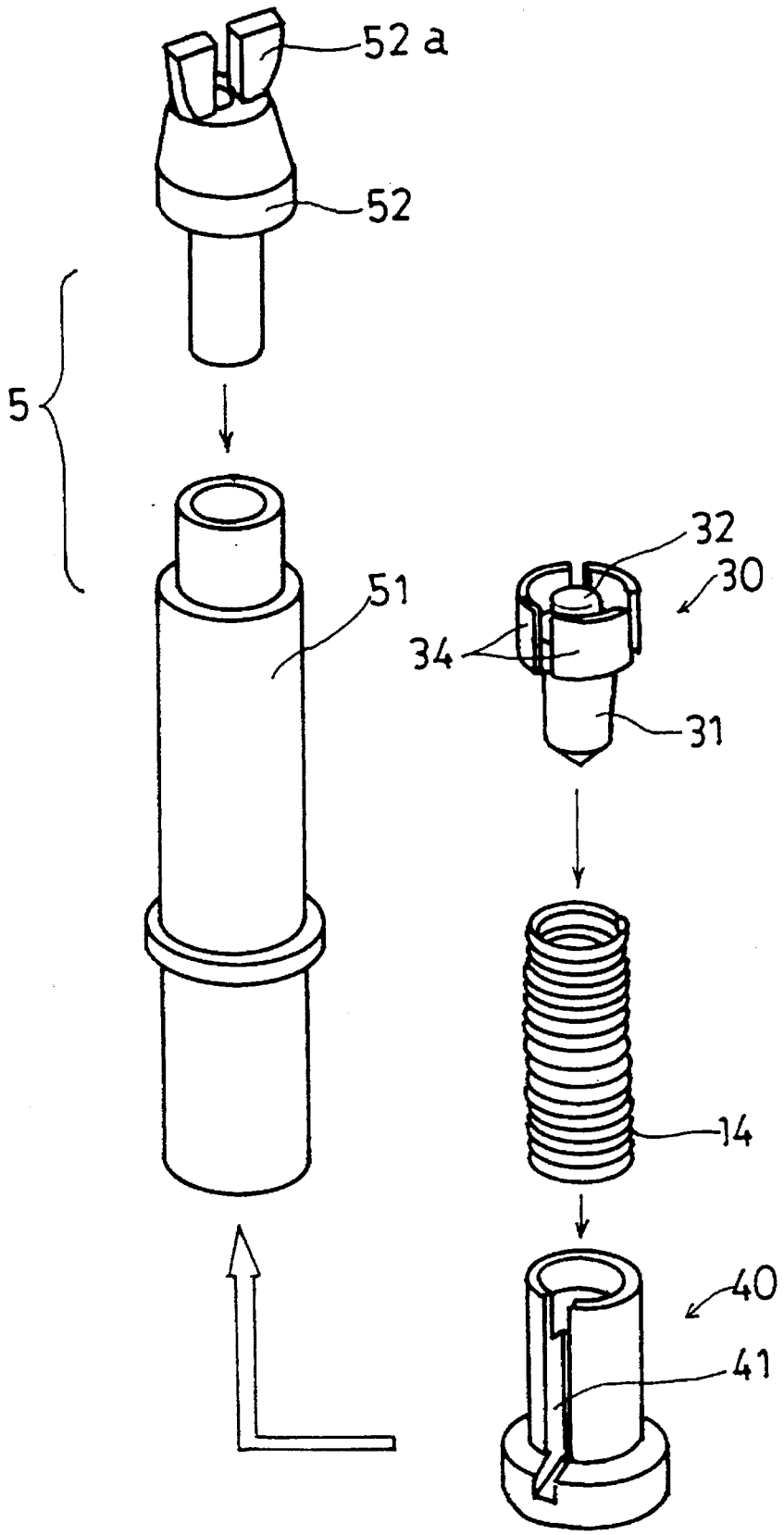
FIG. 2 is an exploded perspective view thereof.
Figure 3:
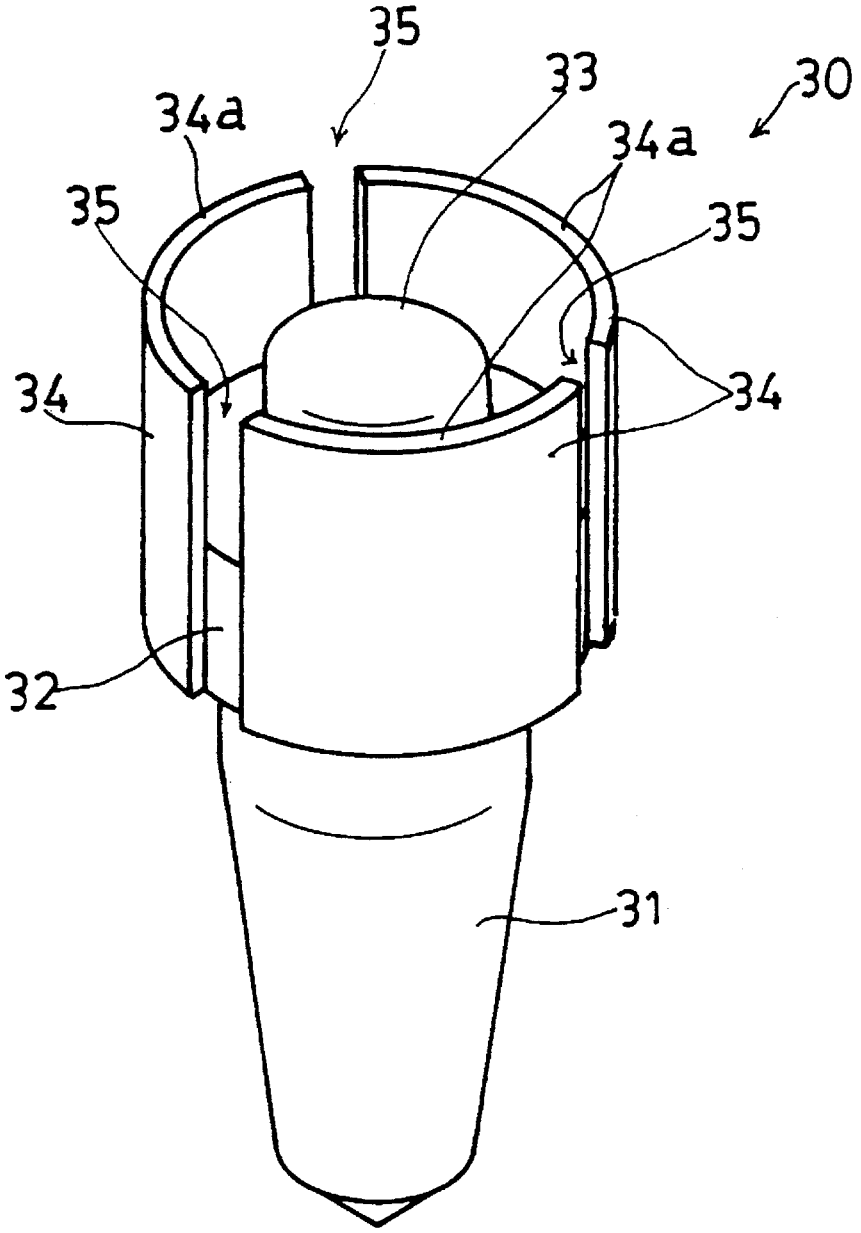
FIG. 3 is an enlarged perspective view of a second valve used in the first embodiment.

FIG. 1 is a sectional view showing a nozzle cylinder and the interior thereof according to the first embodiment of the present invention, in which (A) shows a state before the extinguishment of flame and (B) shows a flame extinguishing state, FIG. 2 is an exploded perspective view of the first embodiment, and FIG. 3 is an enlarged perspective view of a second valve used in the first embodiment.

Figure 8:
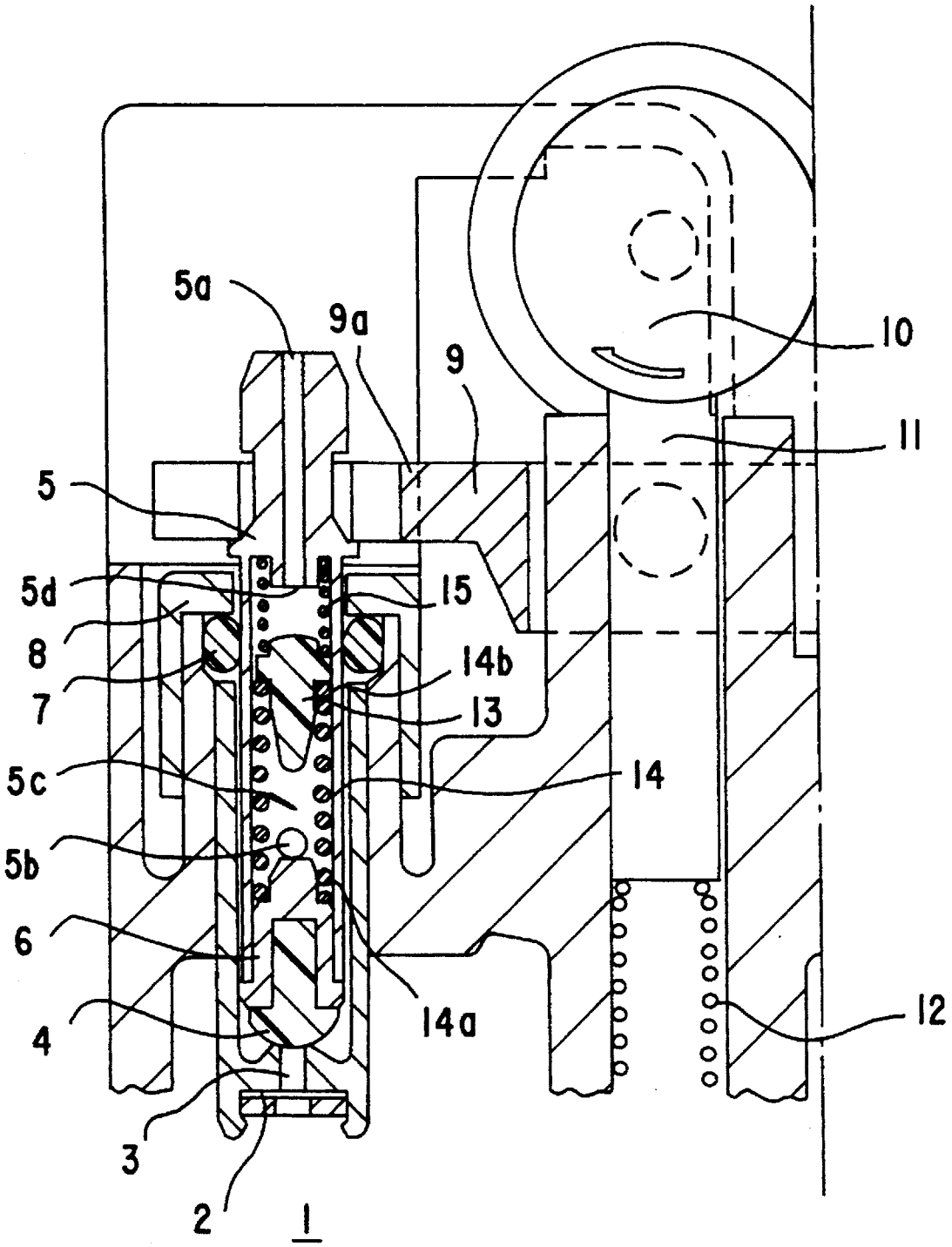
Fig.8 PRIOR ART
FIG. 8 is a partial sectional view of a conventional gas lighter combustion nozzle with an automatic flame extinguishing device incorporated therein and the vicinity thereof.

In the following embodiments, for the purpose of simplification, the components having the same functions as in the conventional example (see FIG. 8) are indicated by the same reference numerals as in FIG. 8 to avoid repeated explanations, and the following description will be directed to only different points from the conventional example.

In the embodiment illustrated in FIG. 1, a nozzle cylinder 5 comprises two components; a main cylinder portion 51 into which is mounted an automatic flame extinguishing device and a gas blow-off hole portion 52 having heat collecting fins **52*a* formed at the top portion, the gas blow-off hole portion 52 being press-fitted into the main cylinder portion 51. When fuel gas blows off and burns, the resulting heat is collected by the heat collecting fins 52*a* and is conducted to a shape memory alloy coil 14, and thus the provision of the heat collecting fins 52*a*** contributes to the improvement of heat conduction efficiency.

A first valve 40 used in the first embodiment fulfills the function of both first valve 4 and bottom plug 6 in the foregoing conventional example and the function of the lateral hole in the conventional example. As shown in FIG. 2, a fuel gas passage 41 for conducting fuel gas into the nozzle cylinder 5 is formed in the first valve 40, and the lower portion of the shape memory alloy coil 14 is press-fitted into the upper portion of the first valve.

A second valve 30 used in the first embodiment, as shown in FIG. 3, is provided with a press-fitting portion 31 to be press-fitted into the shape memory alloy coil 14, a support portion 32 for supporting the upper end portion of the coil 14, and a valve portion 33 for closing a to-be-closed portion **5*d* (see FIG. 1). The second valve 30 is further provided with flange portions 34 as an example of the push-back portion referred to herein, the flange portions 34 being formed so as to surround the valve portion 33. As shown in FIG. 3, the flange portions are three-divided portions, with slits 35 for fuel gas passage being formed between adjacent flange portions 34**.

When a shift is made from the state before the extinguishment of flame shown in FIG. 1(A) to the flame extinguishing state shown in FIG. 1(B), with expansion of the shape memory alloy coil 14, top ends 34*a* of the flange portions 34 come into abutment with the inner wall of the nozzle cylinder 5 and undergo an elastic deformation, as shown in FIG. 1(B). As a result, a force of pushing the shape memory alloy 14 downward in the figure is exerted on the second valve 30. Therefore, when the shape memory alloy coil 14 gets cold, it is forced down by the flange portions 34 and reverts to the state shown in FIG. 1(A). Thus, in this first embodiment, since the second valve 30 is provided with the flange portions 34, the return spring 15 used in the foregoing conventional example (see FIG. 8) is not necessary.

Figure 4:
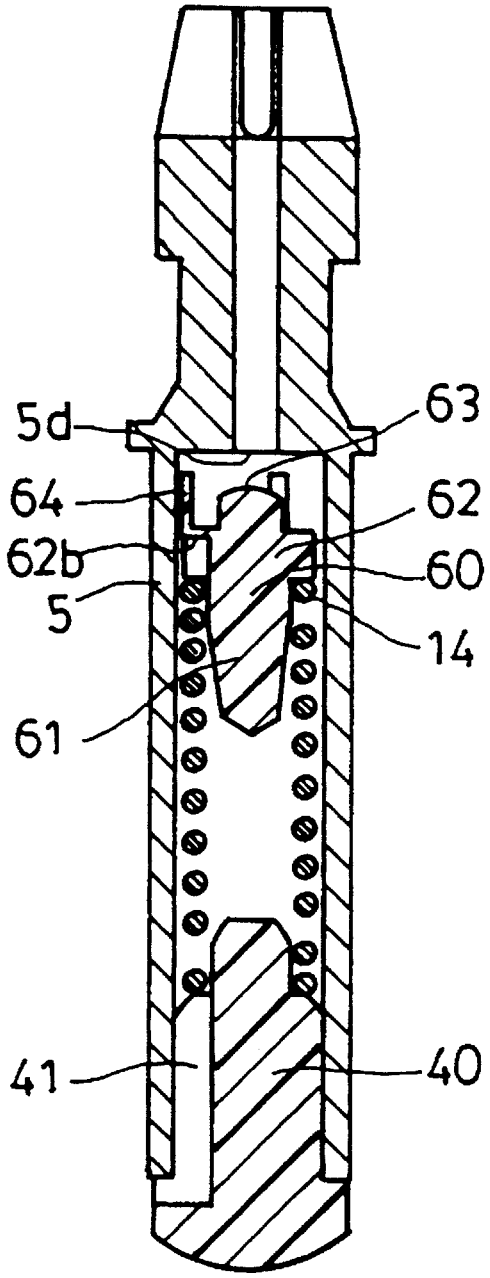
FIG. 4 illustrates a nozzle cylinder and the interior thereof according to the second embodiment of the present invention, in which (A) is a sectional view showing a state before the extinguishment of flame and (B) is a sectional view showing a flame extinguishing state.
Figure 4:
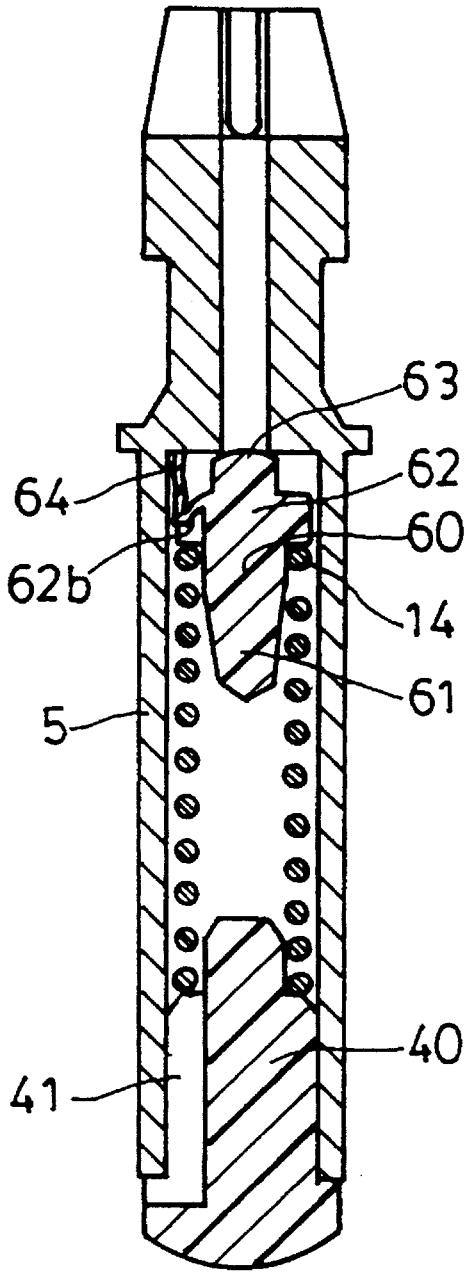
Figure 5:
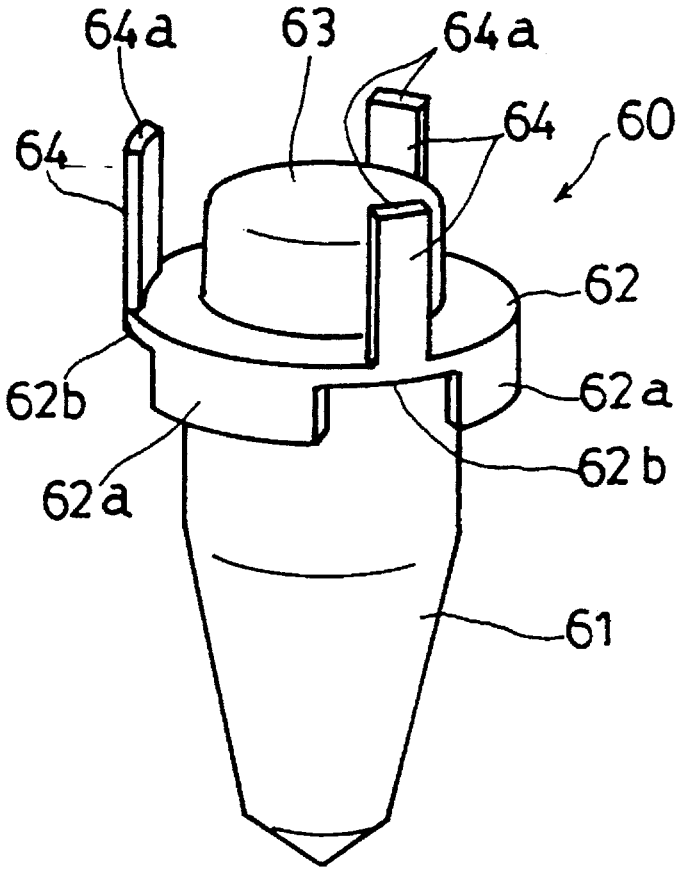
FIG. 5 is an enlarged perspective view of a second valve used in the second embodiment.

FIG. 4 illustrates a nozzle cylinder and the interior thereof according to the second embodiment of the present invention, in which (A) is a sectional view showing a state before the extinguishment of flame and (B) is a sectional view showing a flame extinguishing state, and FIG. 5 is an enlarged perspective view of a second valve used in the second embodiment.

The top portion of a nozzle cylinder 5 used in the second embodiment is formed with quadrant slits so that the collection of heat can be done efficiently. As shown in FIG. 5, like the second valve 3 (see FIG. 3) used in the first embodiment, a second valve 60 used in this second embodiment is also provided with a press-fitting portion 61 to be press-fitted into a shape memory alloy coil 14, a support portion 62 for supporting the upper end of the shape memory alloy coil 14, and a valve portion 63 for closing a to-be-closed portion 5*d* (see FIG. 4). In the support portion 62, thick-walled portions 62*a* and thin-walled portions 62*b* are formed in an alternate manner, with poles 64 being erected on the thin-walled portion 62*b*. In the second embodiment, the thin-walled portions 62*b* and the poles 64 constitute the push-back portion referred to herein. More specifically, when the shape memory alloy coil 14 expands and a shift is made from the state before the extinguishment of flame shown in FIG. 4(A) to the flame extinguishing state shown in FIG. 4(B), top ends 64a of the poles 64 come into abutment with the inner wall of the nozzle cylinder 5 and a force of pushing the shape memory alloy coil 14 downward in the figure is imposed on the coil 14, so that the coil undergoes an elastic deformation. As a result, when the shape memory alloy coil 14 gets cold, it is pushed down by the second valve 60 and reverts to the state shown in FIG. 4(A). Thus, in the second embodiment, since the second valve 60 is provided with the thin-walled portions 62*b* and the poles 64, the return spring used in the conventional example (see FIG. 8) is not necessary, like the first embodiment.

Figure 6:
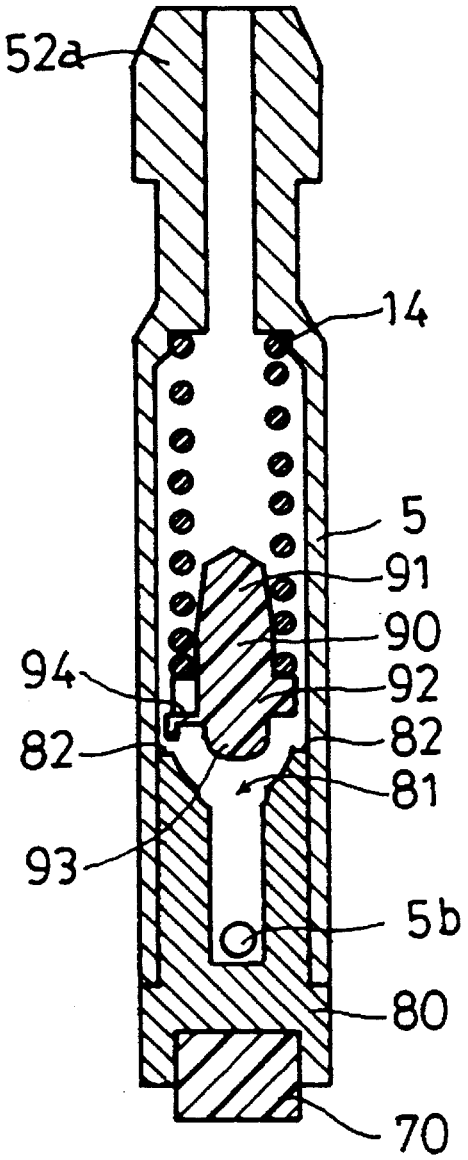
FIG. 6 is a sectional view showing a nozzle cylinder and the interior thereof according to the third embodiment of the present invention.
Figure 7:
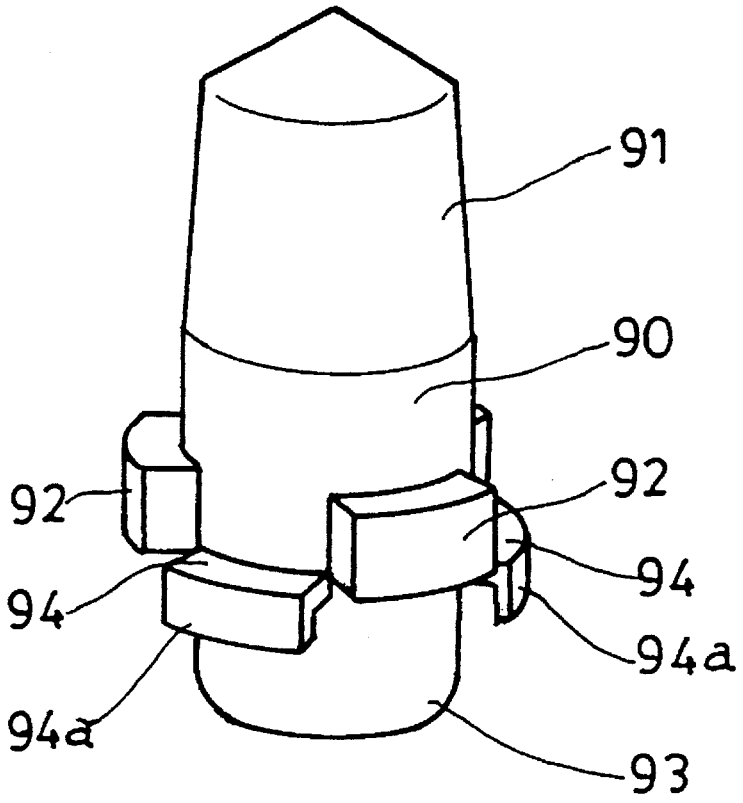
FIG. 7 is an enlarged perspective view showing a second valve used in the third embodiment.

FIG. 6 is a sectional view showing a nozzle cylinder and the interior thereof according to the third embodiment of the present invention, in which a state (A) before the extinguishment of flame and a flame extinguishing state (B) are shown side by side, and FIG. 7 is an enlarged perspective view showing a second valve used in the third embodiment.

A first valve 70 used in the third embodiment, like the first valve 4 used in the conventional example (see FIG. 8), is fixed to the bottom of a bottom plug 80 which is fixed integrally with a nozzle cylinder 5. But in contrast with the conventional example, the upper end portion of a shape memory alloy coil 14 is press-fitted into the nozzle cylinder 5, and a second valve 90 is press-fitted into the lower end portion of the coil 14.

As shown in FIG. 7, the second valve 90 is provided with a press-fitting portion 91 to be press-fitted into the shape memory alloy coil 14, support portion 92 for supporting the lower end of the shape memory alloy coil 14, and a valve portion 93 for closing an opening 81 (corresponding to the to-be-closed portion referred to in the invention) formed in the upper end of the bottom plug 80. The support portion 92 is not formed throughout the entire circumference of the second valve 90 but is divided into three portions, and generally L-shaped arms 94 are formed so as to be each located between adjacent support portions 92.

Figure 6B:
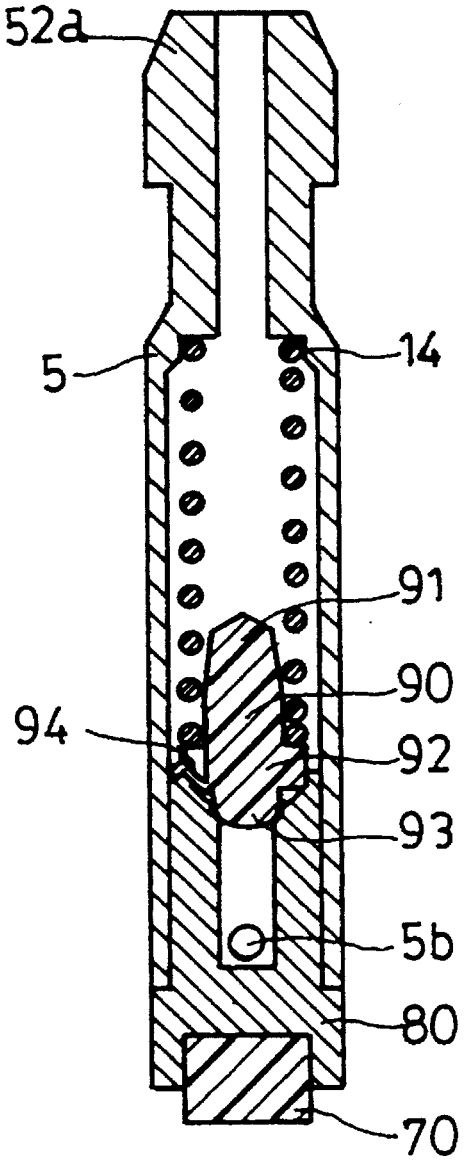

On the other hand, the opening 81 of the bottom plug 80 has a shape corresponding to the shape of the valve portion 92 so that in the flame extinguishing state shown in FIG. 6(B) the valve portion 93 of the second valve 90 can close the opening 81 positively. On the outer periphery of the upper end of the opening 81 is formed an abutment portion 82 for abutment therewith of lower ends 94*a* of the arms 94 during shifting to the flame extinguishing state (FIG. 6(B)).

According to this structure, when the shape memory alloy coil 14 expands and a shift is made from the state before the extinguishment of flame shown in FIG. 6(A) to the flame extinguishing stage shown in FIG. 6(B), the arms 94 deflect elastically, so that a force of lifting the second valve 90, namely, a force of pushing up the shape memory alloy coil 14, is created. Therefore, when the shape memory alloy coil 14 gets cold, it is pushed upward and reverts to the state shown in FIG. 6(A).

In this third embodiment, the arms 94 act as the return springs used in the conventional example (see FIG. 8) and hence the return spring is not needed as is the case with the first and second embodiments. In the third embodiment, in contrast with the first and second embodiments, the upper end of the shape memory alloy coil 14 is fixed to the nozzle cylinder 5, and the second valve 90 is provided in the lower end portion of the coil 14, but it is optional which of the second valve and the shape memory alloy coil is to be positioned up or down. The shape of the second valve, particularly the shape of the push-back portion referred to in the invention, is not specially limited. Various shapes may be adopted, as exemplified above. No limitation is made to the above embodiments, but further improvements which permit fulfillment of the function corresponding to the return spring are also included in the scope of the present invention.

It goes without saying that the present invention is applicable to various shapes of nozzle cylinders, bottom plugs, first valves, etc.

Although in the above embodiments a shape memory alloy coil has been shown as an example of the shape memory member referred to in the invention, it is not always necessary for the shape memory member to be formed of an alloy, nor is it necessary that the shape memory member be coiled, if only it can be deformed so as to cause the second valve to move to and close the to-be-closed portion when the temperature thereof exceeds a predetermined temperature.

Further, according to the construction of the present invention, the shape memory member is pushed back by the push-back portion of the second valve in place of the return spring, so it is possible to eliminate the need of training for imparting a bidirectional property to the shape memory member. But it is to be noted that such impartment of a bidirectional property to the shape memory member is not excluded from the scope of the present invention. The combustion nozzle may be constructed so that the second valve is provided with the push-back portion and the shape memory member is given a bidirectional property to attain a more smooth and positive restoration of the shape memory member.

I claim:

1. In a combustion nozzle for a gas lighter, including:

a nozzle cylinder having a gas blow-off hole formed in the top portion thereof and also having an internal fuel gas passage in communication with said gas blow-off;

a first valve held in the bottom portion of said nozzle cylinder to close a gas outlet hole through which is conducted the fuel gas from a fuel gas storage tank into the interior of the nozzle cylinder;

a second valve disposed movably within said nozzle cylinder to close a to-be-closed portion located halfway of said internal fuel gas passage; and a shape memory member fixed at one end thereof to a predetermined position in said internal fuel gas passage and at the opposite end to said second valve, said shape memory member holding the second valve in a position spaced from said to-be-closed portion at a temperature not higher than a predetermined temperature and being deformed at a temperature exceeding said predetermined temperature, thereby causing the second valve to move toward the to-be-closed portion for closing the internal fuel gas passage, the improvement wherein said second valve comprises a push-back portion which undergoes an elastic deformation upon closing of said to-be-closed portion to urge said shape memory member in a direction in which the shape memory member is pushed back, said push-back portion being integrally formed with a body portion of said second valve such that said push-back portion and said body portion constitute a unitary body comprised of a single material.

2. The improvement of claim 1, wherein said second valve comprises a support portion for supporting an end portion of said shape memory member, and a flange portion extending from said support portion toward said to-be-closed portion of said internal fuel gas passage.

3. The improvement of claim 2, wherein said flange portion is subjected to an elastic deformation when said second valve closes said to-be-closed portion of said internal fuel gas passage.

4. The improvement of claim 2, wherein the support portion includes alternating thick-walled and thin-walled portions.

5. The improvement of claim 1, wherein said second valve is disposed below said to-be-closed portion of said internal fuel gas passage, and said shape memory member moves said second valve in an upward direction to close said to-be-closed portion of said internal fuel gas passage.

6. The improvement of claim 1, wherein said second valve is disposed above said to-be-closed portion of said internal fuel gas passage, and said shape memory member moves said second valve in a downward direction to close said to-be-closed portion of said internal fuel gas passage.

7. A combustion nozzle for a gas lighter, comprising:

a nozzle cylinder having an inner wall defining an internal fuel gas passage, said cylinder having a gas blow-off hole at one end and a gas outlet hole at an opposite end, said inner wall forming an abutment at a transition point where a diameter of said passage changes from a first diameter to a second diameter;

a first valve disposed in said cylinder for closing said gas outlet hole;

a second valve movably disposed in said cylinder for closing said passage at said transition point such that fuel gas cannot flow to said gas blow-off hole, said second valve having a plurality of flange portions integrally formed thereon for undergoing elastic deformation upon closing of said passage at said transition point; and a shape memory member disposed in said cylinder between said first and second valves, said shape memory member holding said second valve in a position spaced from said transition point at a temperature not higher than a predetermined temperature and being deformed at a temperature exceeding said predetermined temperature such that said second valve is urged toward said transition point to close said passage, and said shape memory member being urged away from said transition point upon cooling to a temperature below said predetermined temperature by said flange portions.

8. The combustion nozzle of claim 7, wherein said flange portions each have the shape of a section of a cylinder.

9. The combustion nozzle of claim 7, wherein said second valve includes a support portion for supporting an end of said shape memory member and said flange portions are poles extending away from said support portion.

10. The combustion nozzle of claim 9, wherein said support portion includes alternating thick-walled and thin-walled portions and said poles are formed on said thin-walled portions.

11. The combustion nozzle of claim 7, wherein said flange portions are generally L-shaped arms.

12. A combustion nozzle for a gas lighter, comprising:

a nozzle cylinder having an inner wall defining an internal fuel gas passage, said cylinder having a gas blow-off hole at one end and a gas outlet hole at an opposite end, said inner wall forming an abutment at a transition point where a diameter of said passage changes from a first diameter to a second diameter;

a first valve disposed in said cylinder for closing said gas outlet hole;

a second valve movably disposed in said cylinder for closing said passage at said transition point such that fuel gas cannot flow to said gas blow-off hole, said second valve having means integrally formed thereon for undergoing elastic deformation upon closing of said passage at said transition point; and a shape memory member disposed in said cylinder between said first and second valves, said shape memory member holding said second valve in a position spaced from said transition point at a temperature not higher than a predetermined temperature and being deformed at a temperature exceeding said predetermined temperature such that said second valve is urged toward said transition point to close said passage, and said shape memory member being urged away from said transition point upon cooling to a temperature below said predetermined temperature by said elastic deformation means.

* * * * *